US008721021B2

(12) United States Patent
Nakajima et al.

(10) Patent No.: US 8,721,021 B2
(45) Date of Patent: May 13, 2014

(54) INKJET PRINTING APPARATUS AND PRINTING METHOD

(75) Inventors: Yoshinori Nakajima, Yokohama (JP); Tatsuya Fukushima, Kawasaki (JP); Yasunori Fujimoto, Inagi (JP); Takeshi Honma, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/177,109

(22) Filed: Jul. 6, 2011

(65) Prior Publication Data

US 2012/0019582 A1 Jan. 26, 2012

(30) Foreign Application Priority Data

Jul. 21, 2010 (JP) ..... 2010-163892

(51) Int. Cl.
*B41J 2/205* (2006.01)

(52) U.S. Cl.
USPC ..... 347/15

(58) Field of Classification Search
None
See application file for complete search history.

(56) References Cited

U.S. PATENT DOCUMENTS 5,568,169 A 10/1996 Dudek et al.
6,435,639 B1 8/2002 Nakajima et al.
6,755,496 B2 6/2004 Nishikori et al.
6,827,423 B1 * 12/2004 Katakura et al. ..... 347/40
7,396,098 B2 * 7/2008 Kanematsu et al. ..... 347/15

FOREIGN PATENT DOCUMENTS

CN 1383982 A 12/2002
JP 2002-113850 A 4/2002
JP 2002-166538 A 6/2002
JP 2003-011337 A 1/2003
JP 011337 A * 1/2003

OTHER PUBLICATIONS

Office Action mailed Aug. 27, 2013, in Chinese Patent Application No. 201110199354, Chinese Patent Office.

* cited by examiner

*Primary Examiner* — Matthew Luu
*Assistant Examiner* — Tracey McMillion
(74) *Attorney, Agent, or Firm* — Fitzpatrick, Cella, Harper & Scinto

(57) ABSTRACT

A sharp image is formed without variation in ink spreading around an outer periphery of a print-required region depending on a printing direction. At the time of printing an image by scanning a print medium with a print head for ejecting a first ink which is visible as black and has relatively high permeation properties of penetrating the print medium and a second ink having relatively low permeation properties, a printing apparatus uses the second ink to print on at least an edge area of the print-required region of the print medium, and the first ink to print on a non-edge area surrounded by the edge area. The print head comprises a first nozzle array ejecting the first ink and second nozzle arrays ejecting the second ink. The second nozzle arrays are arranged on opposite sides of the first nozzle array in the scan direction.

11 Claims, 18 Drawing Sheets

INKJET PRINTING APPARATUS AND PRINTING METHOD

BACKGROUND OF THE INVENTION

1. Field of the Invention

This invention relates to an inkjet printing apparatus and a printing method for reciprocating a print head in the main scan direction crossing the direction of feeding a print medium so as to print an image.

2. Description of the Related Art

In a printer that ejects ink drops from nozzles of the print head to form dots on a print medium in order to print an image, filling a certain area with a single color requires printing of dots in the print-required area at a high print density. In such a case, the ejection of a large amount of ink raises the possibility of printing of a blurred outer edge of the print-required area because the ink spreads beyond the print-required area. To solve this disadvantageous problem, Japanese Patent Laid-Open No. 2003-011337 discloses a technique of using ink having relatively high permeation properties (hereinafter referred to as "high permeation ink") to form dots in the interior area of the print-required area, and using ink having relatively low permeation properties (hereinafter referred to as "low permeation ink") to form dots in the outer peripheral area. Further, Japanese Patent Laid-Open No. 2003-011337 discloses the arrangement to firstly form dots positioned in the interior area and then dots positioned in the outer area in order to more clearly depict the outer peripheral edge of the print-required area.

However, problems as described below arise in techniques for printing by use of ink of two types differing in permeation properties as described above. In the case of bidirectional printing by use of two print heads, one ejecting the high permeation ink and the other ejecting the low permeation ink, lined up in the main scan direction and of all the nozzles, the printing order of ejection of the high permeation ink and the low permeation ink is changed between printing in one direction (the going direction) of the reciprocation and printing in the other direction (the return direction). As a result, the image quality is changed with the scan direction.

SUMMARY OF THE INVENTION

It is an object of the present invention to provide an inkjet printing apparatus and method capable of forming a sharp image without variation in spreading of ink around an outer periphery of a print-required area depending on the printing direction.

An inkjet printing apparatus according to the present invention, includes:

scanning unit configured to cause a print head capable of ejecting a first ink and a second ink to scan a print medium so as to print an image thereon, the second ink having a similar color to a color of the first ink and having relatively lower permeation properties with respect to the print medium than permeation properties with respect to the print medium of the first ink; and a printing control unit configured to control ejection of ink from the print head so as to print on an edge area in a print medium using the second ink without using the first ink, and print on a non-edge area in the print medium using first ink, the edge area and non-edge area being located in a printing area corresponding to a image to be printed on the print medium using at least one of the first and second ink, the edge area being located adjacent to a region where neither the first ink nor second ink is ejected, the non-edge area being located adjacent to the edge area, wherein the print head comprises a first nozzle array capable of ejecting the first ink and a plurality of second nozzle arrays capable of ejecting the second ink, the plurality of second nozzle arrays are arranged along a scan direction of the scanning unit, and the first nozzle array is disposed between the plurality of second nozzle arrays.

Further features of the present invention will become apparent from the following description of exemplary embodiments (with reference to the attached drawings).

DESCRIPTION OF THE EMBODIMENTS

Figure 1:
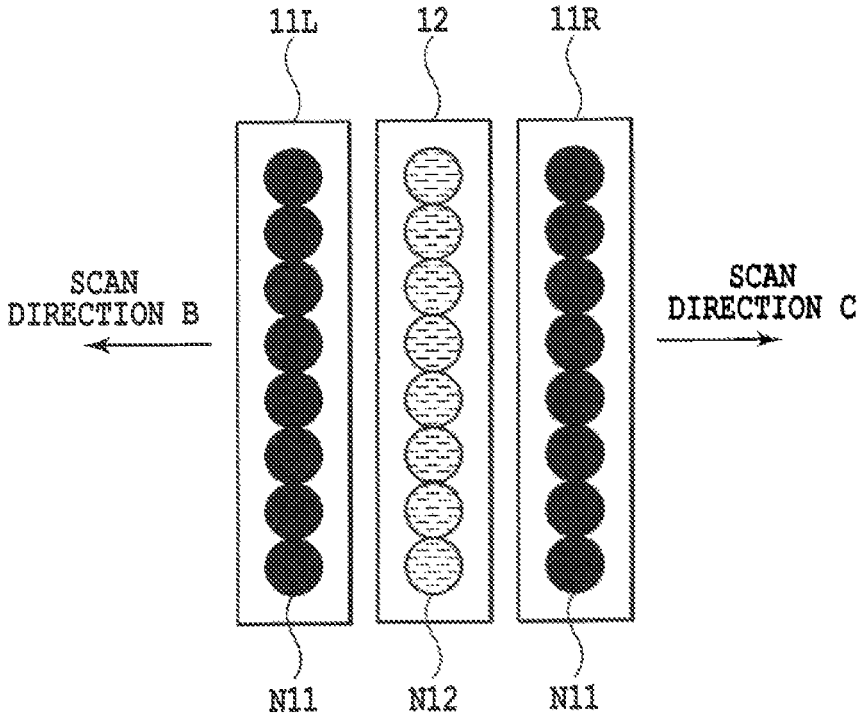
FIG. 1 is a diagram of a print head for ejecting black ink used in an embodiment according to the present invention.

FIG. 1 shows the configuration of a print head for ejecting black ink used in an embodiment according to the present invention. In FIG. 1, a print head 12 is interposed between two print heads 11R, 11L in the scan directions B, C.

The print head 12 includes a first nozzle array N12 capable of ejecting a first ink relatively tending to penetrate a print medium (hereinafter referred to as "high permeation ink"). The print head 11L includes a second nozzle array N11 capable of ejecting a second ink which is of a similar color to that of the first ink and has relatively lower permeation properties than the first ink (hereinafter referred to as "low permeation ink"). The print head 11R includes a second nozzle array N11 capable of ejecting the low permeation ink as in the case of the print head 11L. That is, the print heads 11L, 11R, 12 include the first nozzle array capable of ejecting the first ink and a plurality of second nozzle arrays capable of ejecting the second ink. A plurality of second nozzle arrays N11 are disposed along a relative scan direction, while the first nozzle array N12 is disposed between the plurality of second nozzle arrays N11.

Figure 2:
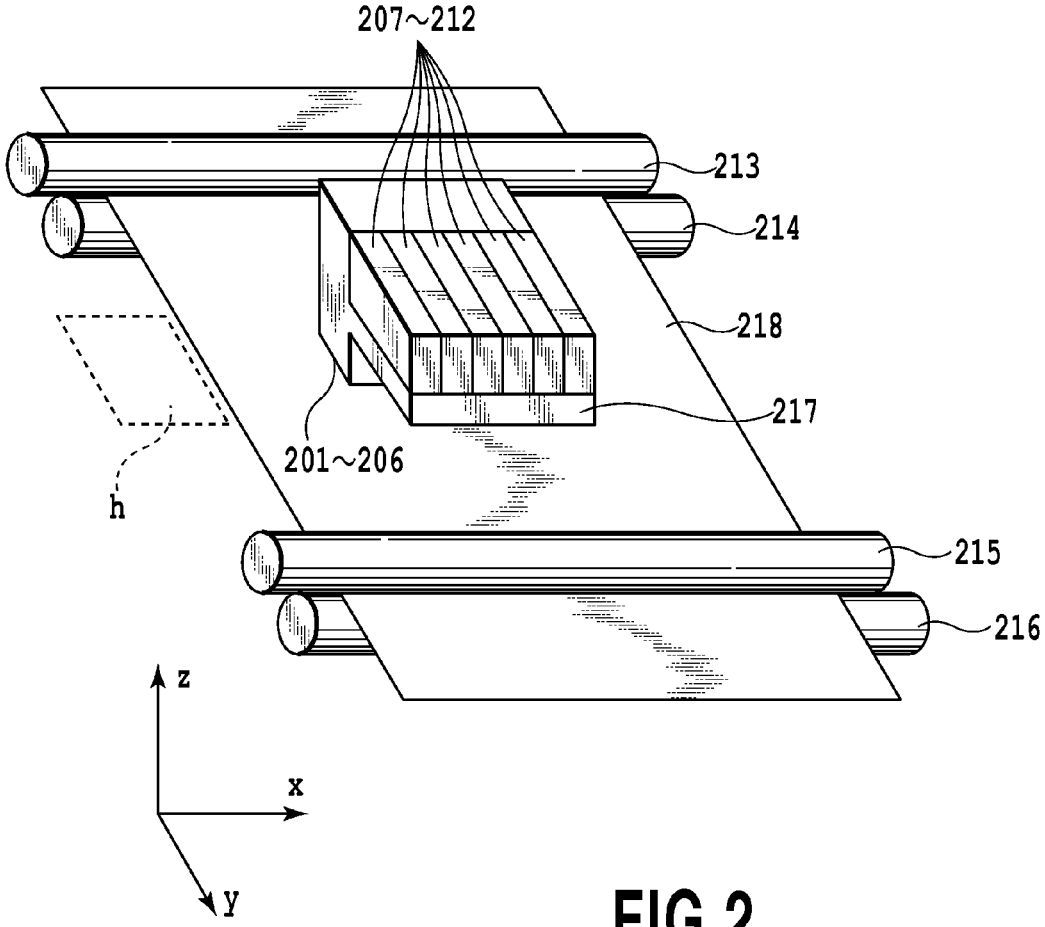
FIG. 2 is a perspective view of a printing apparatus used in an embodiment according to the present invention.

When the print heads scan in the scan direction B, the print heads 11L, 12, and then the print head 11R are operated for printing. When the print heads scan in the scan direction C, the print heads 11R, 12 and then the print head 11L are operated for printing. FIG. 2 is a schematic perspective view illustrating the structure according to an embodiment of a color inkjet printing apparatus to which the present invention is applicable. Ink tanks 207-212 respectively contain six color inks (low-permeation-type black, high-permeation-type black, low-permeation-type black, cyan, magenta, yellow: Ke, Km, Ke, C, M, Y), and are structured to be capable of supplying these six inks to the print heads 201-206. Connecting part of them with the print heads for ejecting black ink in FIG. 1, the print head 201 corresponds to the print head 11L, the print head 202 corresponds to the print head 12 and the print head 203 corresponds to print head 11R.

Feed rollers 213, 215 rotate while nipping a print medium (paper sheet) 218 in conjunction with respective auxiliary feed rollers 214, 216, to feed the print medium 218, and also have a function of holding it. A carriage 217 is capable of being equipped with the ink tanks 207-212 and the print heads 201 to 206, and is structured to, together with the print heads and the ink tanks, reciprocate in the X direction. The print heads eject the ink during the reciprocation of the carriage 217, thereby printing an image on the print medium. In the non-print operation such as in recovery operation of the print heads 201 to 206 or the like, the carriage 217 is controlled to wait in a home position h indicated with a dotted line in FIG. 2.

The print heads 201 to 260 waiting in the home position shown in FIG. 2 receive a printing start instruction, thereupon ejecting ink to print an image on the print medium 218 while moving in the X direction in FIG. 2 along with the carriage 217. One move (scan) of the print head allows an image to be printed on an area of a width corresponding to the array range of the ejection openings of the print heads 201 to 206.

Upon completion of printing associated with one scan of the print heads 201 to 206 in the main scanning direction (the positive X direction), the carriage 217 moves in the opposite direction (the negative X direction) for a printing scan of the print heads 201 to 206. After the completion of the previous printing scan and before the beginning of the subsequent printing scan, the feed rollers 213, 215 rotate to feed a print medium toward the sub-scan direction (Y direction) crossing the main scan direction. The printing scan of the print heads and the feeding of the print medium are repeated in this manner in order to complete the printing of an image on the print medium 218. The printing operation of ejecting ink from the print heads 201 to 206 is performed based on the control by control means which will be described later.

The above example represents a structure of mounting the ink tanks 207 to 212 and the print heads 201 to 206 on the carriage 217 to be separable. Instead, a form of mounting a cartridge including a combination of the ink tanks 207 to 212 and the print heads 201 to 206 on the carriage may be employed. Further, a form of mounting an integral multicolor head capable of ejecting inks of different colors from the single print head on the carriage may be employed.

Figure 3:
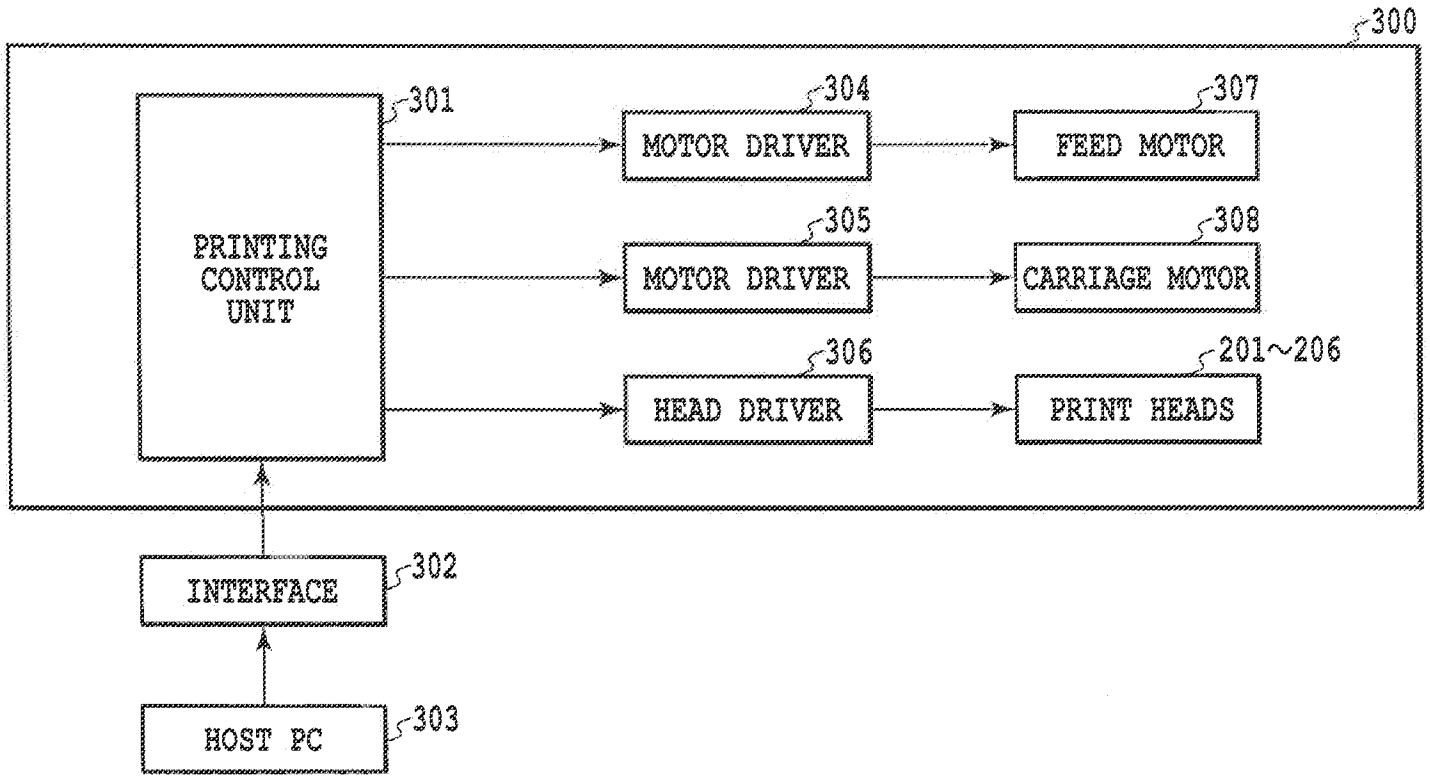
FIG. 3 is a block diagram of a printing apparatus used in an embodiment according to the present invention.

FIG. 3 is a block diagram schematically illustrating the configuration of a print control circuit of a color inkjet printing apparatus shown in FIG. 2. The inkjet printing apparatus 300 is connected via an interface 302 to a data supply device such as a host computer (hereinafter referred to as "host PC") 303 or the like. A variety of data, control signals related to printing, and the like which are transmitted from the data supply device are applied to a printing control unit 301 of the inkjet printing apparatus 300. The printing control unit 301 controls motor drivers 304, 305 and a head driver 306, which will be described later, in accordance with the control signals received through the interface 302. The print control unit 301 processes the received image data. Reference numeral 307 denotes a feed motor for rotating the feed rollers 213, 215 to feed the print medium 218. Reference numeral 308 denotes a carriage motor for causing the carriage 217 carrying the print heads 201 to 206 to reciprocate. Reference numerals 304, 305 denote motor drivers for respectively driving the feed motor 307 and the carriage motor 308. Reference numeral 306 denotes head drivers for driving the print heads 201 to 206, a plurality of head drivers being provided in correspondence with the number of print heads.

Embodiment 1

Figure 4:
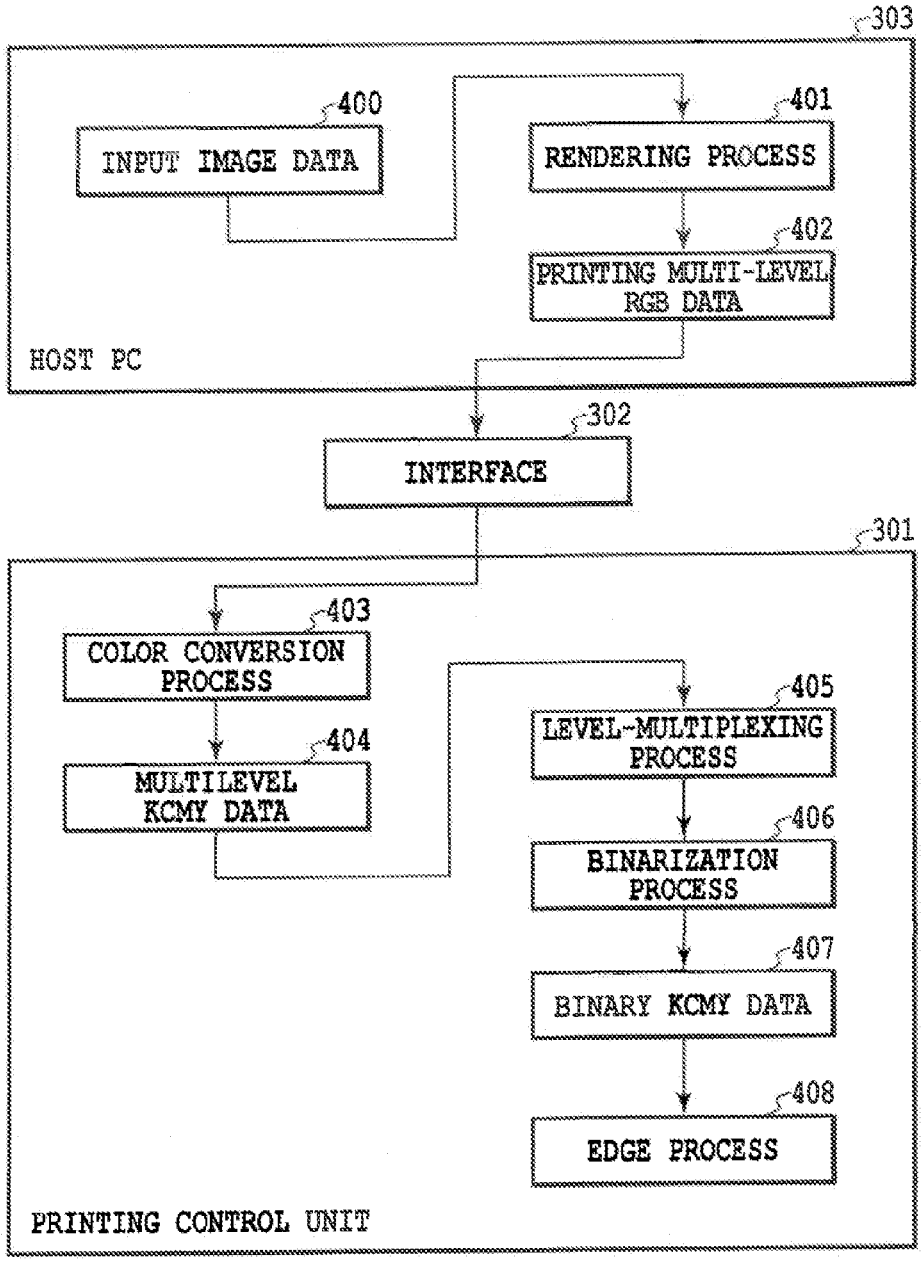
FIG. 4 is a diagram illustrating a data processing flow used in an embodiment according to the present invention.

FIG. 4 is a function block diagram schematically illustrating the configuration for processing image data in an image processing system made up of the inkjet printing apparatus and the host PC. The printing control unit 301 of the inkjet printing apparatus processes the data transmitted through the interface 302 from the host PC 303 on which a printer driver is installed.

The host PC 303 receives input image data 400 from the application, and performs a rendering process 401 on the received input image data 400 at a resolution of 600 dpi. Thus, multi-level RGB data 402 for use in printing is generated. In the embodiment, the printing multi-level RGB data 402 is 8-bit data. The printing multi-level RGB data 402 thus generated is transferred to the printing control unit 301.

The printing control unit 301 performs a color conversion process 403 for converting the printing multi-level RGB data 402 into multi-level (8-bit) KCMY data 404 corresponding to the colors of KCMY inks. Then, the printing control unit 301 performs a level-multiplexing process 405 on the multi-level (8-bit) KCMY data 404, for example, ternarizes the data 404 by use of error diffusion. Then, the printing control unit 301 performs a binarization process as shown in FIG. 5 on the ternarized KCMY data to create binary KCMY data 407 of a 600 dpi×1200 dpi resolution.

Figure 5:
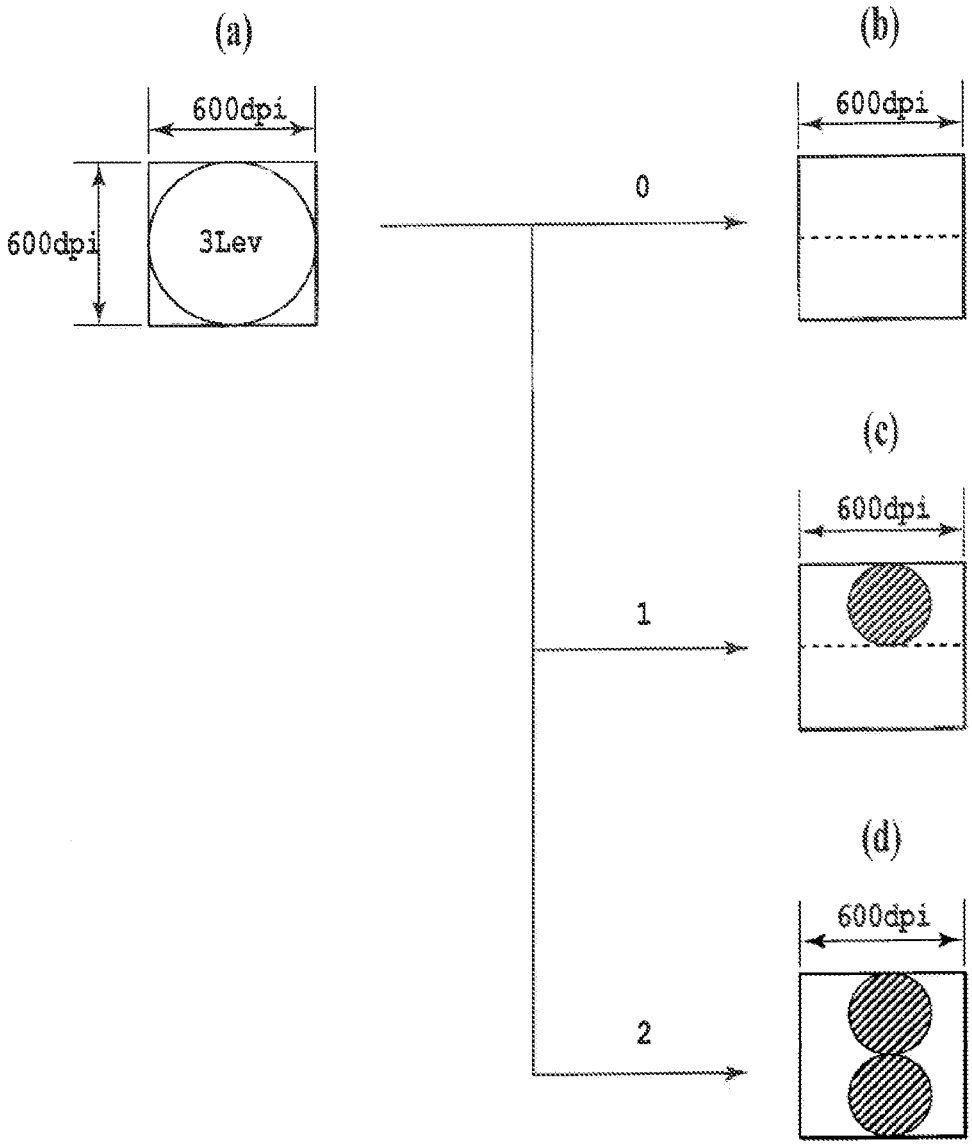
FIG. 5 is a diagram illustrating the binarization process used in an embodiment according to the present invention.

A part (a) in FIG. 5 represents ternarized data of 600 dpi. Black circles shown in parts (c), (d) represent print data after binary expansions. Depending upon a level of the ternarized data, the data is expanded to part (b) when the level is zero, to part (c) when the level is one, and to part (d) when the level is two. The printing control unit 301 performs an edge process 408 on K data of the binary KCMY data 407 thus expanded.

Figure 6:
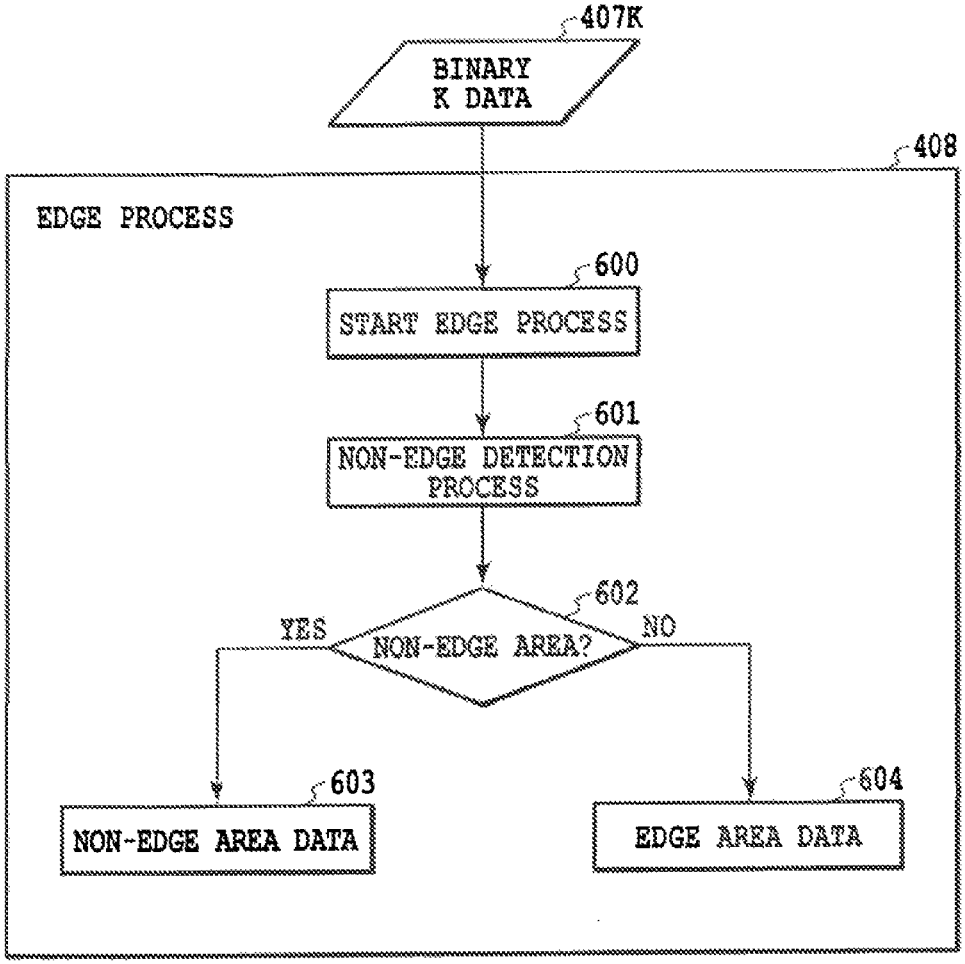
FIG. 6 is a flow diagram of the edge process used in an embodiment according to the present invention.

FIG. 6 is a diagram illustrating the edge process. The printing control unit 301 performs a non-edge detection process 601 on the binary K data 407K. From the binary K data is created data 603 on a non-edge area surrounded by (adjacent to) an edge area adjacent to a non-printing region in which the image is not printed. Data of the binary K data which is not satisfactory for the non-edge data is determined as edge data 604. In the embodiment, a two-pixel (2-dot) outer periphery in the K data is determined as non-edge data.

Figure 7A:
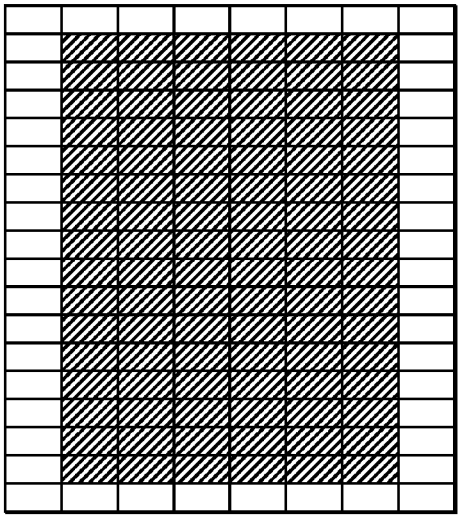
FIGS. 7A, 7B and 7C are diagrams illustrating edge data and non-edge data in an embodiment according to the present invention.
Figure 7B:
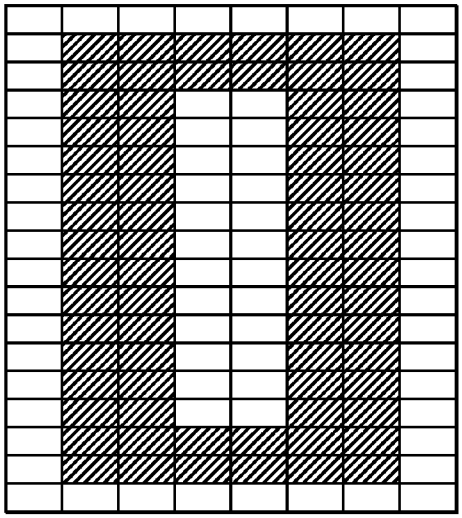
Figure 7C:
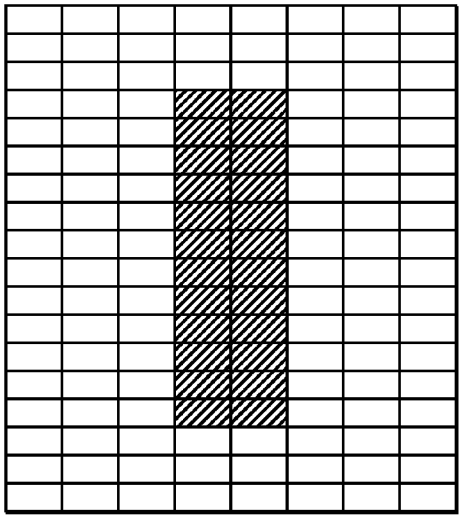

FIGS. 7A to 7C illustrate diagrams when the image data is divided into the edge data and the non-edge data. FIG. 7A is the binary K data 407K received by the printing control unit 301. In this connection, FIG. 7B is the edge data detected through the non-edge detection process 601, and FIG. 7C is the non-edge data. A two-pixel boundary is determined as edge data in the embodiment, but the number of pixels in the edge area is not particularly limited to this. To obtain the technical effect of the present invention, the width of the edge area is preferably within four pixels.

Figure 8:
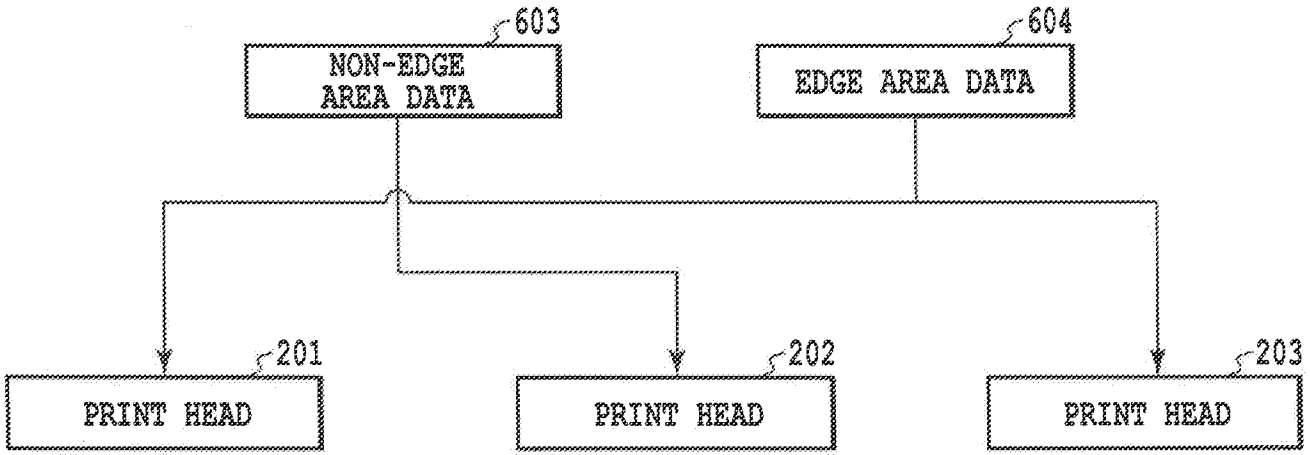
FIG. 8 is a flow diagram of data processing in embodiment 1.

FIG. 8 illustrates a flow of data supplied to the print heads 201 to 203. The non-edge data 603 is supplied to the print head 202 for ejecting the high permeation ink, while the edge data 604 is supplied to the print heads 201, 203 for ejecting the low permeation ink.

Figure 9A:
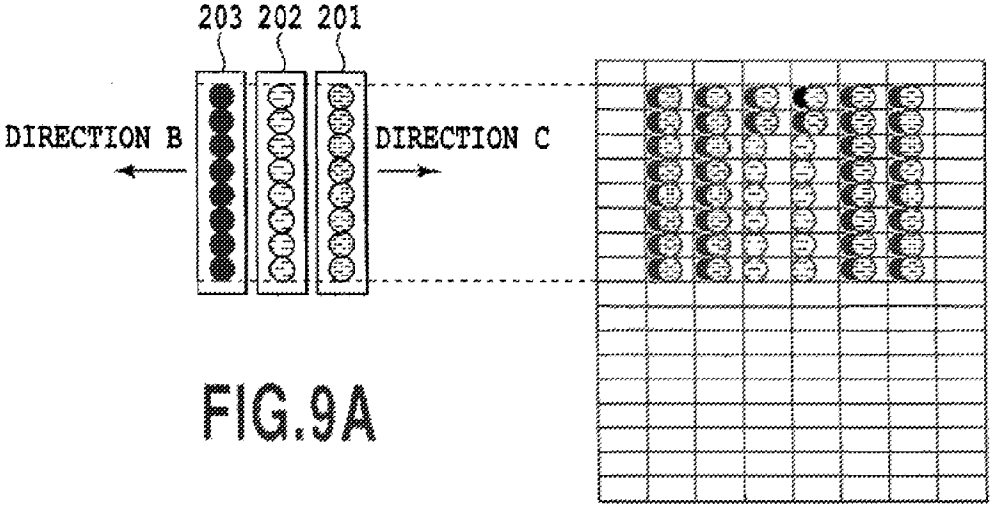
FIGS. 9A and 9B are diagrams illustrating the printing operation in embodiment 1.
Figure 9B:
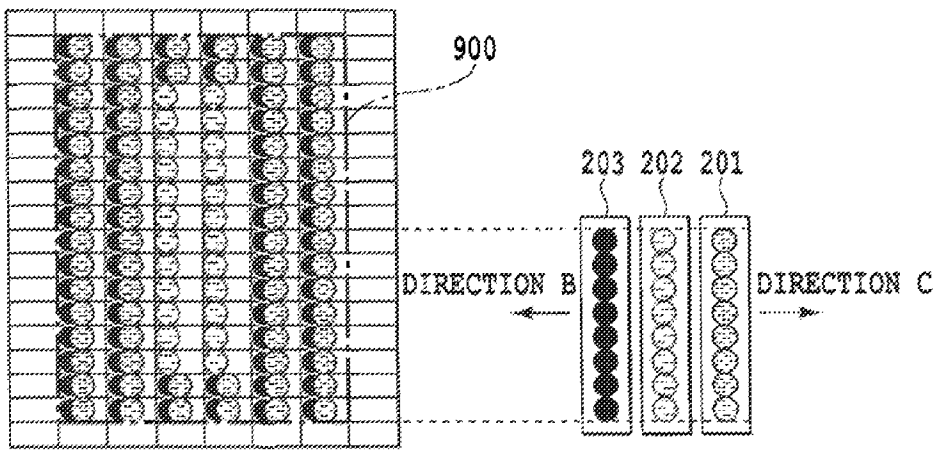

FIGS. 9A, 9B illustrate a method of printing the binary edge K data and non-edge K data shown in FIGS. 7A to 7C. Reference numerals 201 to 203 denote the print heads. The print heads 201, 203 eject drops of the black, low-permeation ink, and the print head 202 ejects a drop of the black, high permeation ink. First, while the carriage 217 scans in the scan direction C, the upper half of the data shown in FIGS. 7A to 7C is printed. At this stage, after only the edge data has been printed by the head 201, only the non-edge data is printed by the head 202 and then only the edge data is printed by the head 203. That is, the edge area is printed by use of the second ink before and after the non-edge area is printed by use of the first ink. Next, the print medium 218 is moved forward. Then, while the carriage 217 scans in the scan direction B, the lower half of the data shown in FIGS. 7A to 7C is printed. At this stage, after only the edge data has been printed by the head 203, only the non-edge data is printed by the head 202 and then only the edge data is printed by the head 201. That is, the edge area is printed by use of the first ink alone, and the non-edge area is printed by use of the second ink alone.

Such printing makes it possible to implement the bidirectional printing in which the order of ejection of the black, low-permeation ink and the black, high-permeation ink is the same in both the directions. As a result, in the printing in the scan direction B and the printing in the scan direction C, in the edge of the boundary area 900, the black, low-permeation ink printed on the outer peripheral area can equally prevent the spreading of the black, high-permeation ink printed on the interior area. Thus, the sharpness of the boundary area 900 can be inhibited from varying in the going-direction printing and the return-direction printing, thus printing an image with a clear boundary 900 regardless of the printing direction.

In the embodiment, the rate of printing of each head 201, 203 is set to, for example, 50% or the total of the rates of printing of the heads 201, 203 is set to, for example, 75%, and the rate of printing of the head 202 is set to, for example, 50%. In this point, the rate of printing means a percentage of pixels allowing for printing, of the pixels included within a unit region. In a common technique for changing the rate of printing, a mask pattern for determining for each pixel whether the ejection of ink drops is permitted is applied to binary print data on determination of ejection or non-ejection of ink drops on a pixel basis, in order to thin out the print data.

As a result, the amount of the low-permeation ink ejected per unit region in the edge area is increased to be greater than the amount of the high-permeation ink ejected per unit region in the non-edge area, thus increasing the quantity of ink application in the edge area to be greater than that in the non-edge area. This makes it possible to enhance the inhibitive effects on spreading of the high-permeation ink printed on the internal region in the boundary area 900.

The following is the composition of each black ink used in the embodiment. The proportion of each component is expressed in parts by mass (the total of respective components is 100 parts by mass).

High-Permeation Ink

| | |
|---|---|
| Liquid pigment dispersion | 50 parts by mass |
| Glycerin | 6 parts by mass |
| Diethylene glycol | 5 parts by mass |
| Acetylenol EH (trade name, produced by Kawaken Fine Chemicals) | 1 part by mass |
| Water | remainder |

Low-Permeation Ink

| | |
|---|---|
| Liquid pigment dispersion | 50 parts by mass |
| Glycerin | 6 parts by mass |
| Diethylene glycol | 5 parts by mass |
| Acetylenol EH (trade name, produced by Kawaken Fine Chemicals) | 0.1 parts by mass |
| Water | remainder |

The above liquid pigment dispersion is obtained as follows.

Liquid Pigment Dispersion

After 10 g of carbon black of which the surface area is 230 $m^2/g$ and the DBP oil absorption is 70 ml/100 g, and 3.41 g of p-Aminobenzoic acid have been well mixed with 72 g of water, 1.62 g of nitric acid was added drop by drop to this mixture, which was then stirred at 70° C. After a few minutes, a solution including 1.07 g of sodium nitrite was added to 5 g of water, which then was further stirred for one hour. The slurry thus obtained was filtered by use of Toyo Roshi (filter paper) No. 2 (trade name, made by Advantis company), and then the pigment particles were sufficiently rinsed with water and then dried in an oven at 90° C. Then, water was added to the pigment thus obtained to produce a pigment solution with a pigment concentration of 10% by mass. The above method was carried out to obtain a liquid pigment dispersion in which a self-dispersing carbon black disperses, the carbon black having the surface to which the hydrophilic group is bonded through the phenyl group as represented by the following formula and being anionically charged.

In the embodiment, the permeation properties of the high-permeation ink and the low-permeation ink are relatively changed by a surface active agent, acetylenol EH (trade name, produced by Kawaken Fine Chemicals) (ethylene oxide-2,4,7,9-tetramethyl-5-decyne-4,7-diol), but they may be changed by use of another solvent.

The ink composition employed in the embodiment should be changed depending on a product vision aimed for each product. The above-described composition is an example of application of the present invention, and the use of two types of inks being identical in hue and having relatively different permeation properties is possible.

The coloring material employed in the embodiment is one called self-dispersing pigment, in which the hydrophilic group adheres to the pigment particles. Otherwise, a material which is called a resin dispersing pigment, in which resin adheres to the pigment particles and the hydrophilic group of the resin exhibits water solubility, may be used. According to studies of the writers and the like, the use of the self-dispersing pigment is more desirable for the purpose of applying the present invention, but the advantageous effects of the present invention were successfully provided even in the use of the resin dispersing pigment.

Embodiment 2

A difference of embodiment 2 from embodiment 1 is that the amount of the ink ejected for later printing the edge area after the data on the edge area has been thinned out is set to be greater than the amount of the ink ejected for earlier printing the edge area. Specifically, the rate of printing provided to the nozzle array N11 of plural second nozzle arrays N11 which is located backward in the scan direction from the first nozzle array N12 is controlled to be greater than that provided to the nozzle array N11 located forward in the scan direction from the first nozzle array N12.

Figure 10:
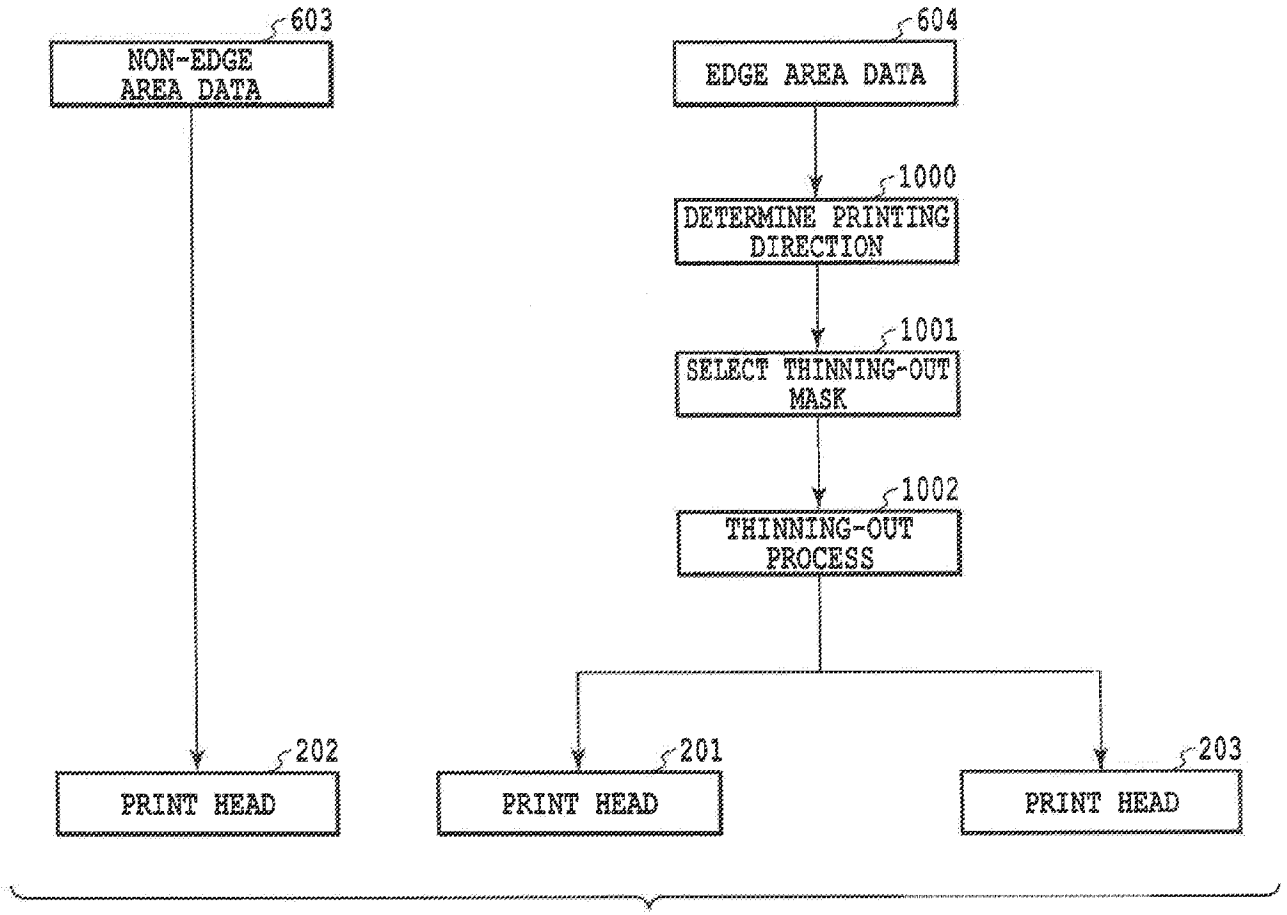
FIG. 10 is a flow diagram of the data processing in embodiment 2.
Figure 11:
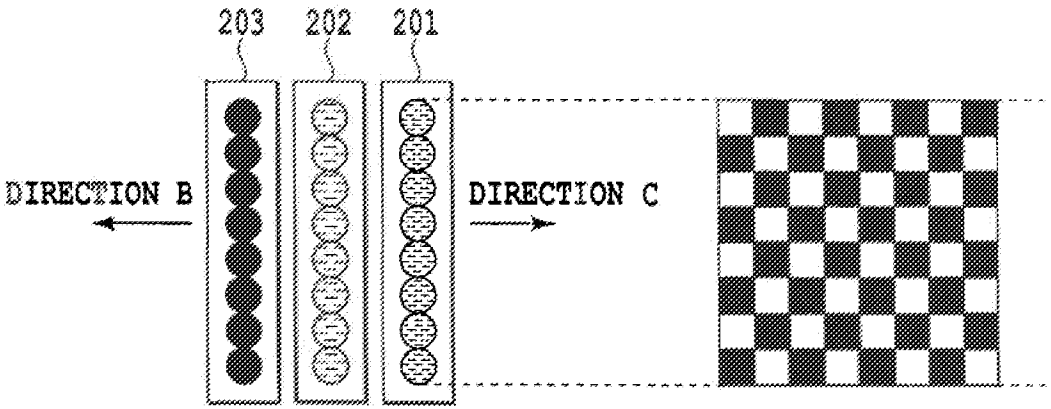
FIG. 11 is a diagram of the thinning-out mask in embodiment 2.

FIG. 10 shows a flow of data supplied to the print heads 201 to 203 in the embodiment. The non-edge area data 603 is supplied to the print head 202. Regarding the edge area data 604, a printing direction is determined (1000), then a thinning-out mask is selected (1001), then a thinning-out process (1002) is performed, and then data to be supplied to the print heads 201, 203 is determined. The embodiment uses a fixed 8-by-8 mask of a vertical size equal to that of the ejecting opening row of the print head 201, 203 as shown in FIG. 11 for the thinning-out process. The mask is adapted to eliminate the data on a black fill area. A fixed staggered-pattern mask is used to perform the thinning-out process, but the mask pattern is not particularly limited.

Figure 12A:
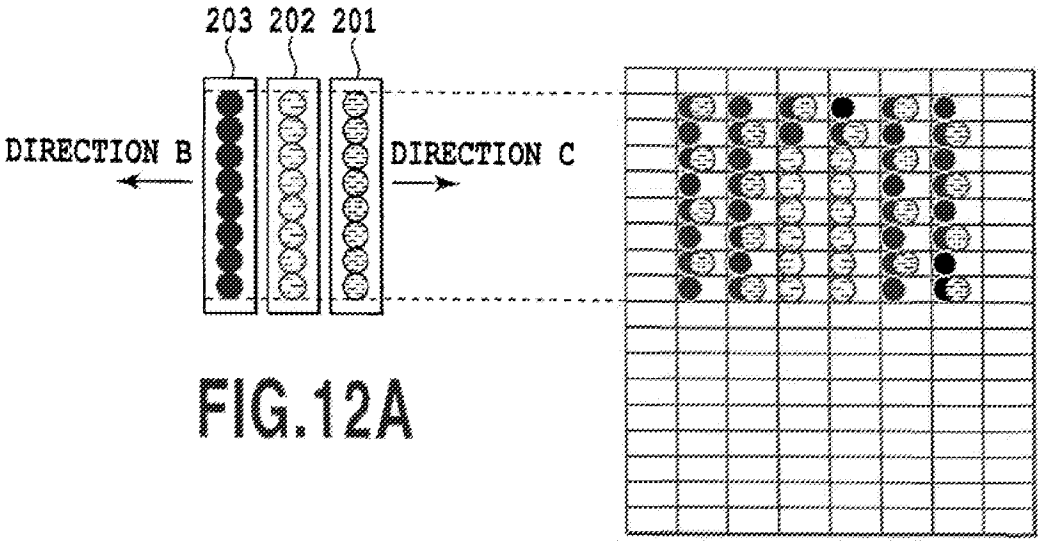
FIGS. 12A and 12B are diagrams illustrating the printing operation in embodiment 2.
Figure 12B:
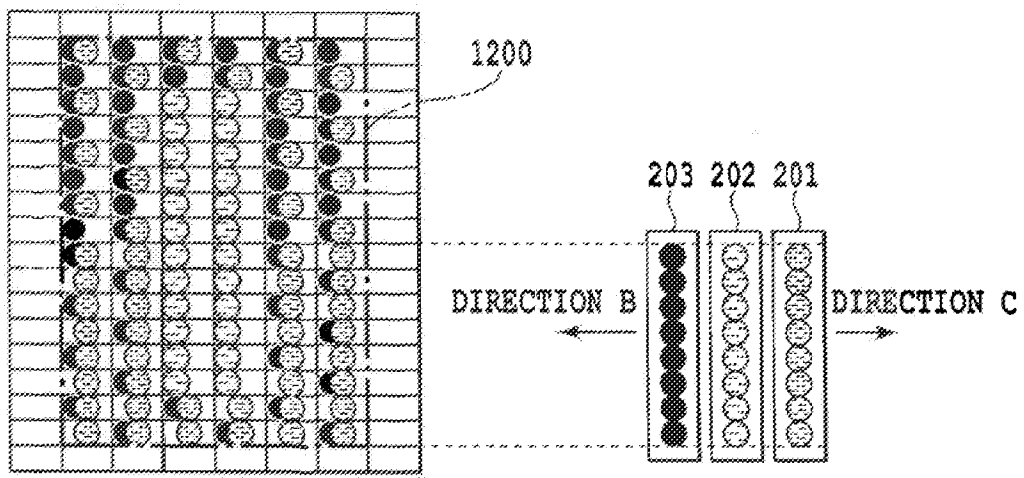

FIGS. 12A and 12B illustrate the printing operation in the embodiment. First, the operation of printing data on the upper half in FIG. 7 while the carriage 217 scans in the scan direction C is described. The non-edge area data is supplied to the print head 202. On the other hand, the edge area data is subjected to the printing-direction determination (1000), and then the thinning-out mask as shown in FIG. 11 is applied to the data to be supplied to the print head 201. The data without masking is supplied to the print head 203.

Next, the operation of printing the data of the lower half in FIGS. 7A to 7C while the carriage 217 scans in the scan direction B is described. The non-edge area data is supplied to the print head 202. On the other hand, the edge area data is subjected to the printing-direction determination (1000), and then the thinning-out mask as shown in FIG. 11 is applied to the data to be supplied to the print head 203. The data without masking is supplied to the print head 201.

By increasing the amount of the low-permeation ink after the black, high-permeation ink has penetrated the print medium as described above, inhibition of mixing of the black, low-permeation ink and the black, high-permeation ink in the outer peripheral area is made possible. Thus, the amount of the black, low-permeation ink applied to the outer peripheral area is decreased, but printing of an image with clear edges is achieved. Also, as in the case of embodiment 1, it is possible that the order of ejection of the black, low-permeation ink and the black, high-permeation ink is the same irrespective of the printing direction. As a result, similarly, an image with clear edges can be printed in both the going-direction printing and the return-direction printing.

Embodiment 3

A difference of embodiment 3 from embodiment 1 is that not only the edge area data, but also the non-edge area data is printed by use of the print heads 201 and 203 which eject the black, low-permeation ink.

Figure 13:
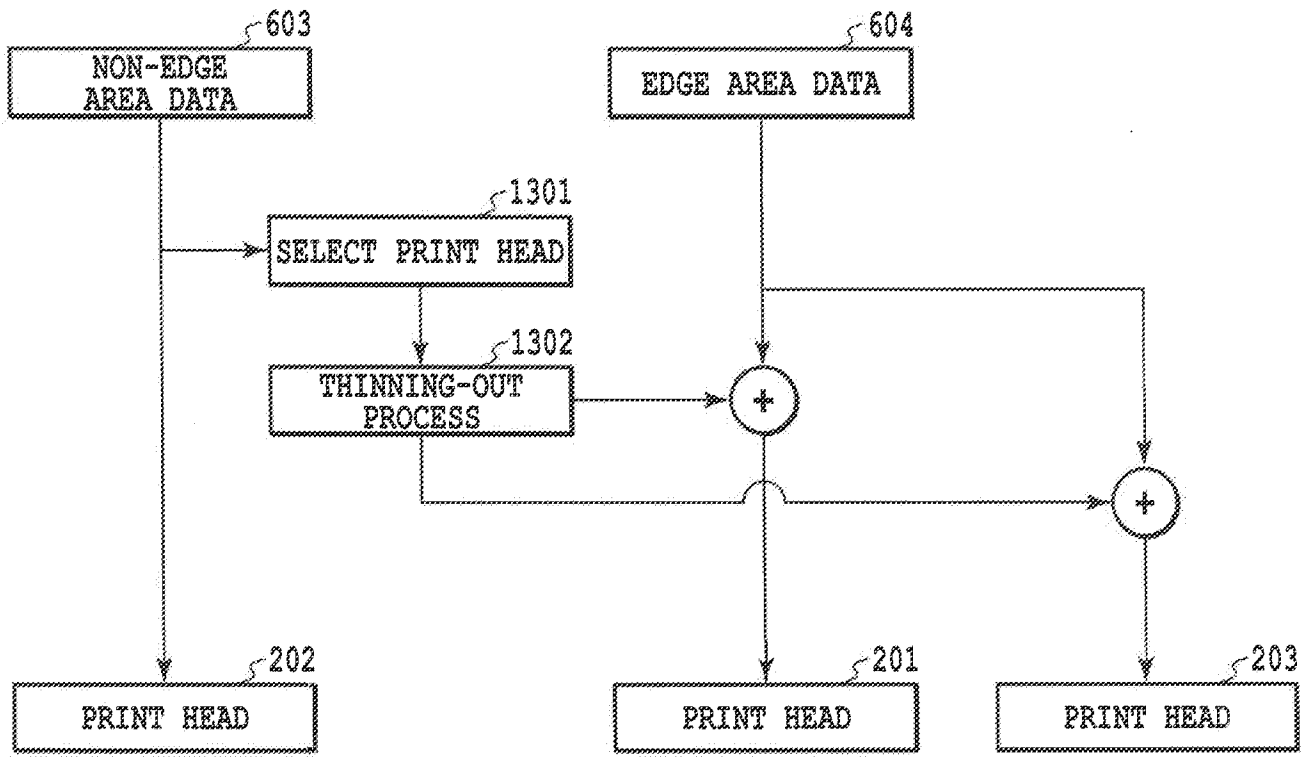
FIG. 13 is a flow diagram of the data processing in embodiment 3.
Figure 14:
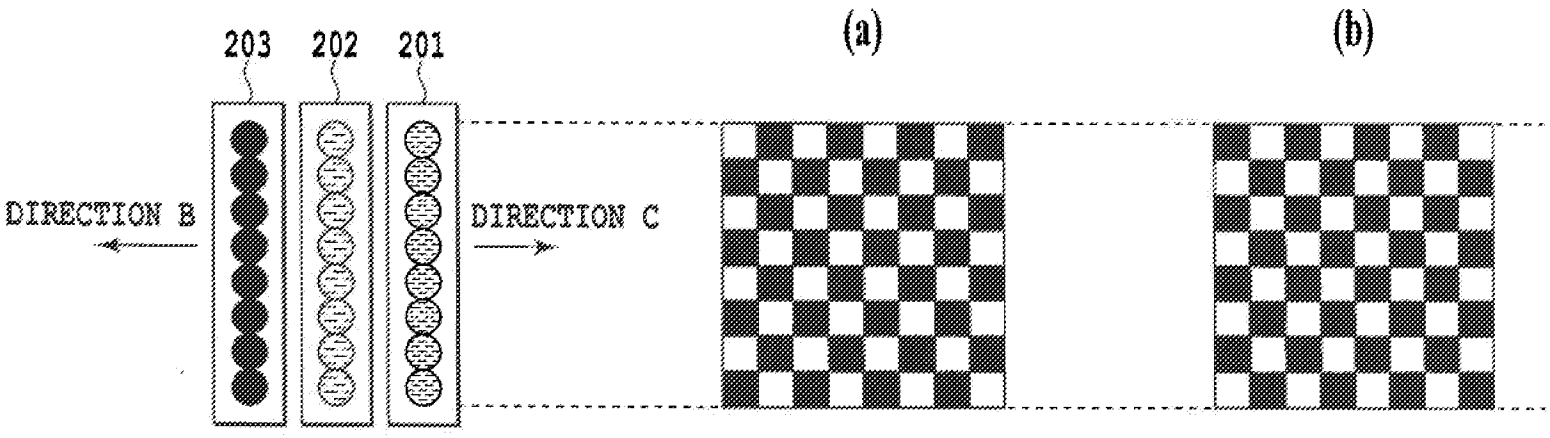
FIG. 14 is a diagram of the thinning-out mask in embodiment 3.

FIG. 13 shows a flow of data supplied to the print heads 201 to 203 in the embodiment. The non-edge area data 603 is supplied to the print head 202. Further, in the print head selection 1301, the print head 201 or the print head 203 is selected for data supply. Then, data of the AND of the data subjected to the thinning-out process (1302) and the edge area data 604 is supplied to the print heads 201, 203. The embodiment uses fixed 8-by-8 masks (a), (b) of a vertical size equal to that of the ejecting opening row of the print heads 201, 203 as shown in FIG. 14 for the thinning-out process. The mask is adapted to eliminate the data on a black fill area. The embodiment uses the masks that are complementary to each other such as a staggered pattern and the reverse staggered pattern, but is not limited to establishment of the thinning-out pattern and the complementary relationship.

Figure 15A:
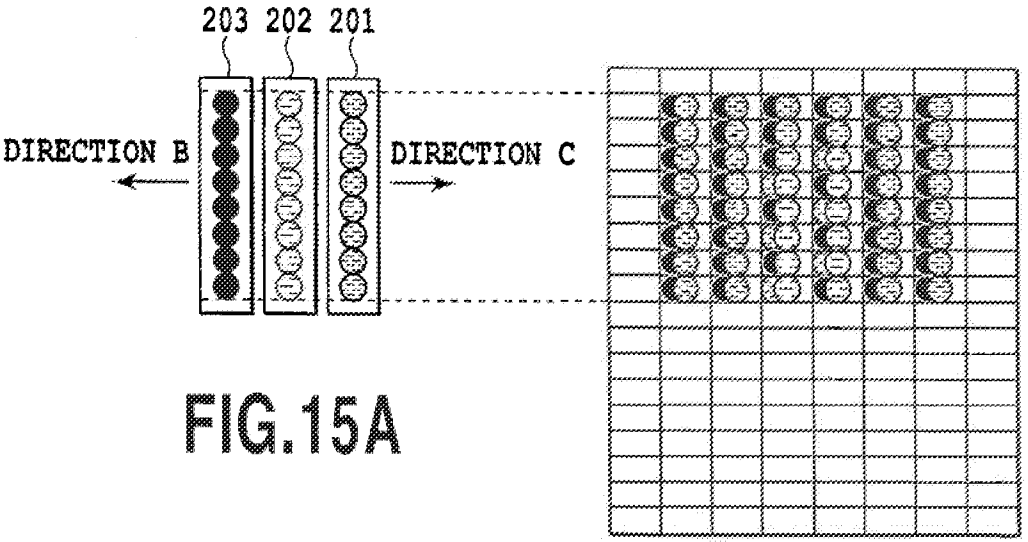
FIGS. 15A and 15B are diagrams illustrating the printing operation in embodiment 3.
Figure 15B:
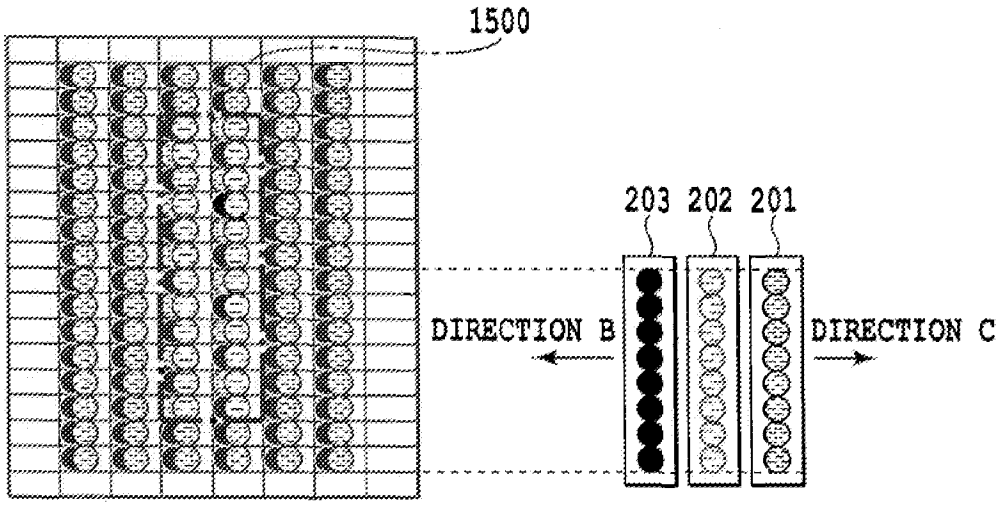

FIGS. 15A and 15B illustrate the printing operation. The print heads 201, 203 print data on the edge area, and the print head 201 prints the non-edge area data thinned out by use of the mask (b) as illustrated in FIG. 14 and the print head 203 prints the non-edge area data thinned out by use of the mask (a). The print head 202 prints the data on the non-edge area.

Such a printing manner makes it possible to print an image with clear edges regardless of the printing direction as in the case of embodiment 1. In addition, because the black, low-permeation ink is applied to the non-edge area before the black, high-permeation ink is applied, the ink permeation to the print medium is alleviated, improving the black density in the non-edge area (black frame 1500).

Embodiment 4

A difference of embodiment 4 from embodiment 3 is, as in the case of embodiment 2, that the data on the edge area is thinned out and the rate of printing the edge area with the low-permeation ink which is used for printing at a later stage is set higher.

Figure 16:
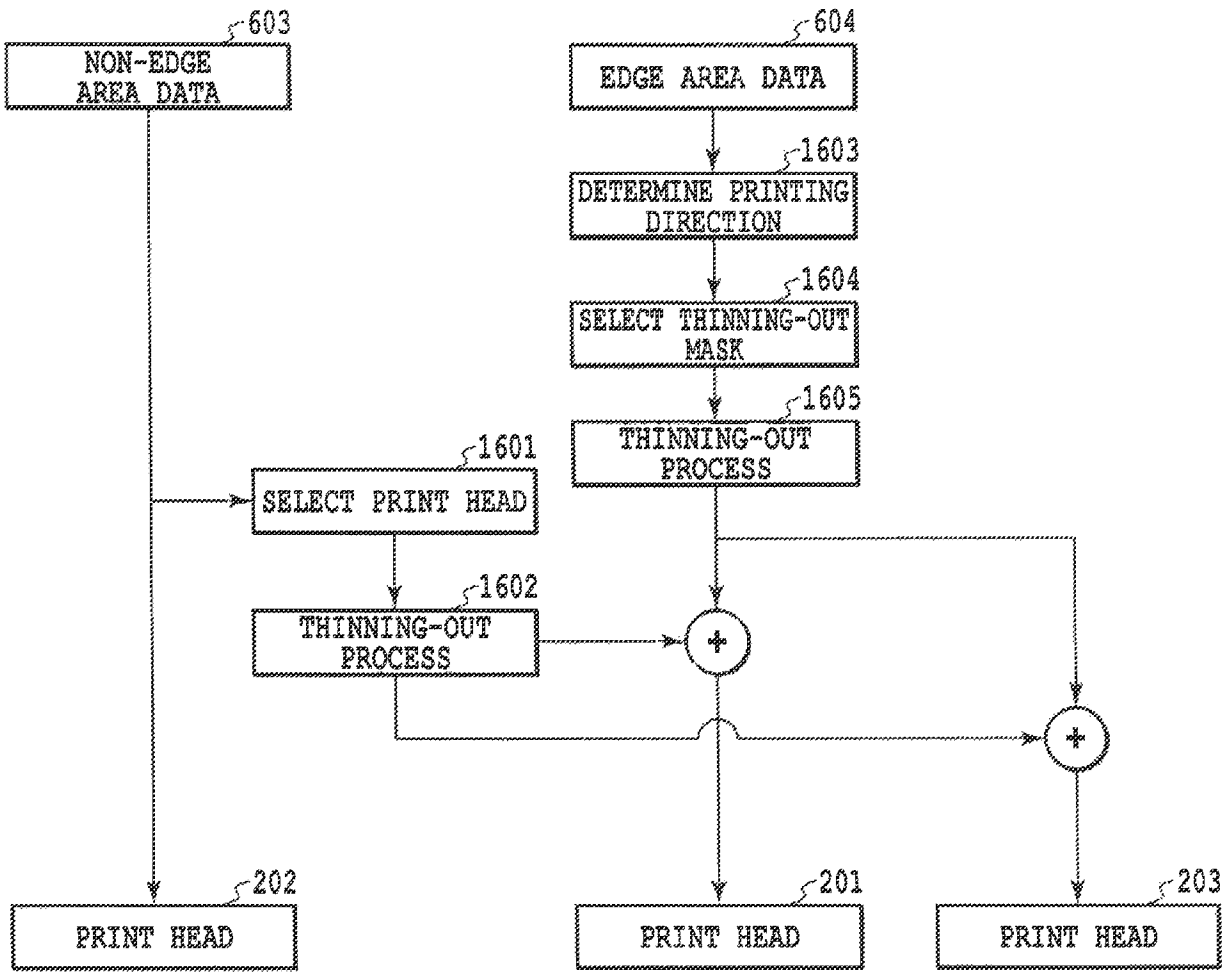
FIG. 16 is a flow diagram of the data processing in embodiment 4.

FIG. 16 shows a flow of data supplied to the print heads 201 to 203 in the embodiment. The non-edge area data 603 is supplied to the print head 202. Further, after the print head 201 or the print head 203 is selected for data supply (1601), the thinning-out process (1602) is performed. The data supplied to the print head 201 after the thinning-out process is assumed as non-edge_data A, and the data supplied to the print head 203 is assumed as non-edge_data B. On the other hand, the edge area data is subjected to the print-direction determination (1603), then a thinning-out mask is selected (1604) and then the thinning-out process (1605) is performed. Then, the data to be supplied to the print heads 201, 203 is determined. The data supplied to the print head 201 after the thinning-out process for the edge area is assumed as edge_data C, and the data supplied to the print head 203 is assumed as edge_data D. Then, data of the AND of the non-edge_data A and the edge_data C is supplied to the print head 201, and data of the AND of the non-edge_data B and the edge_data D is supplied to the print head 203.

Figure 17:
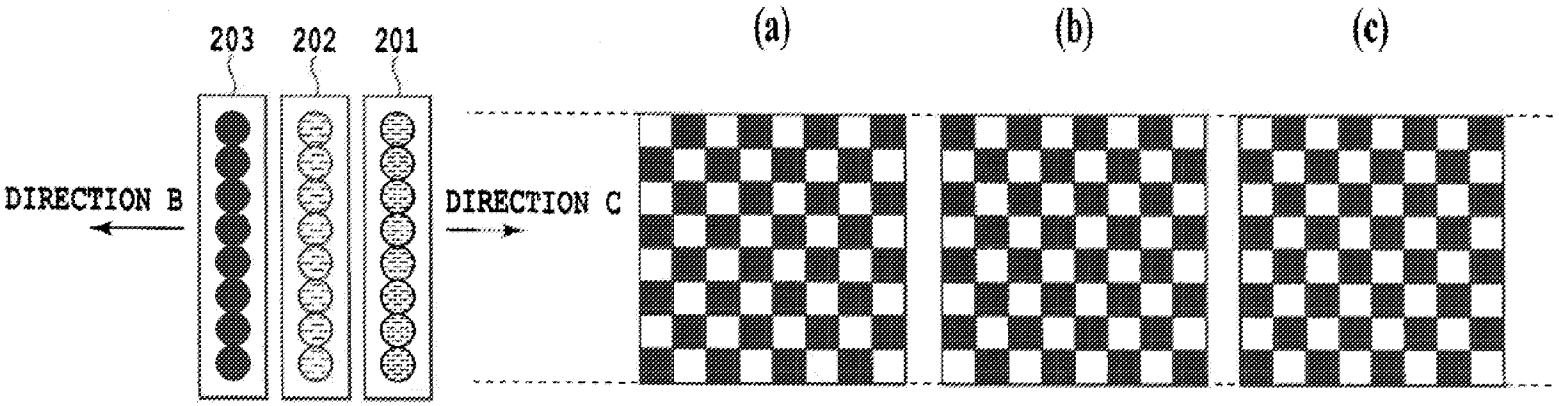
FIG. 17 is a diagram of the thinning-out mask in embodiment 4.

The embodiment uses fixed 8-by-8 masks (a), (b), (c) of a vertical size equal to that of the ejecting opening row of the print heads 201, 203 as shown in FIG. 17 for the thinning-out process. In the thinning-out process 1602, the mask (a) is used for the print head 203, and the mask (b) is used for the print head 201. In the thinning-out process 1605, the mask (c) in FIG. 17 is used. It should be noted that, the thinning-out pattern is not particularly limited, and the complementary relationship between the mask (a) and the mask (b) is not particularly limited.

Figure 18A:
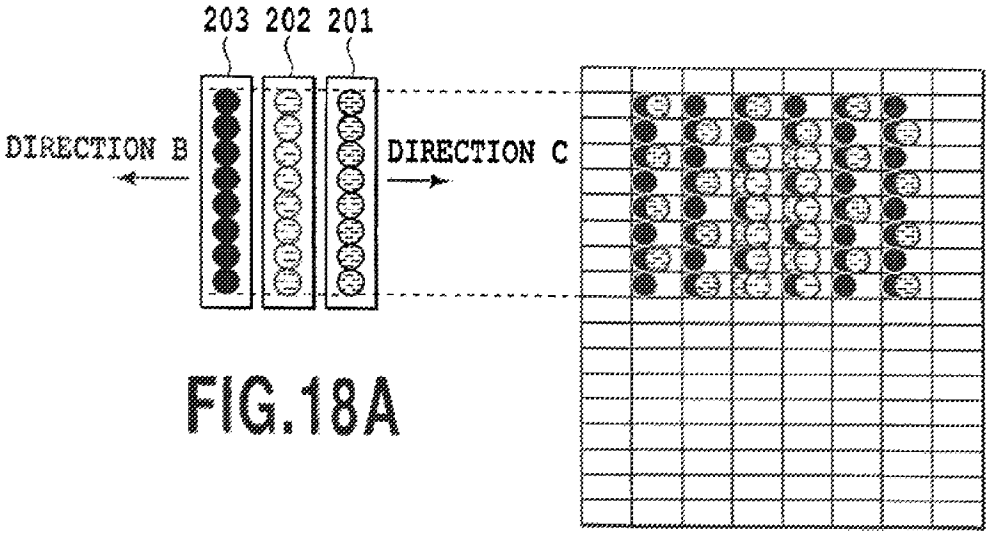
FIGS. 18A and 18B are diagrams illustrating the printing operation in embodiment 4.
Figure 18B:
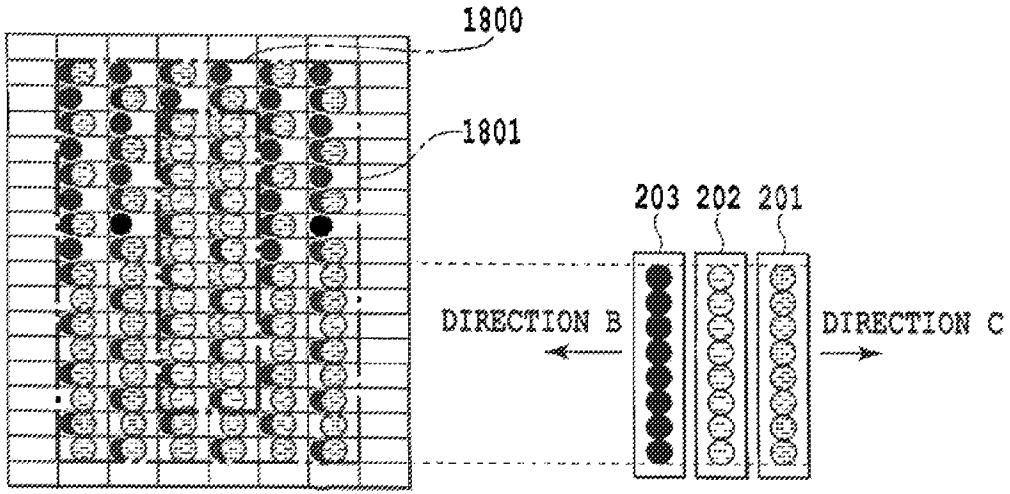

FIGS. 18A and 18B show the printing operation in the embodiment. Initially, the operation of printing the data of the upper half in FIGS. 7A to 7C while the carriage 217 scans in the scan direction C is described. The non-edge area data is supplied to the print head 202, the thinning-out process 1602 is performed, and then data to be supplied to the print heads 201, 203 are determined. On the other hand, the edge area data is subjected to the printing-direction determination (1603), and then the thinning-out mask illustrated in part (c) in FIG. 17 is applied to the data to be supplied to the print head 201, and the thinning-out mask is not applied to the data to be supplied to the print head 203. The AND of the determined non-edge data to be supplied to the print heads 201, 203 and the edge data is supplied to the print heads 201, 203.

Next, the operation of printing the data in the lower half in FIGS. 7A to 7C while the carriage 217 scans in the scan direction B is described. The non-edge area data is supplied to the print head 202, the thinning-out process 1602 is performed, and then data to be supplied to the print heads 201, 203 is determined. On the other hand, the edge area data is subjected to the printing-direction determination (1603), and then the thinning-out mask illustrated in part (c) in FIG. 17 is applied to the data to be supplied to the print head 203, and the thinning-out mask is not applied to the data to be supplied to the print head 201. The logical product (AND) of the determined non-edge data to be supplied to the print heads 201, 203 and the edge data is supplied to the print heads 201, 203.

Thus, as in the case of embodiment 3, an image with clear edges is printed regardless of the printing direction. In addition, because the black, low-permeation ink is applied to the non-edge area (black frame 1800) before the black, high-permeation ink is applied, the ink permeation to the print medium is alleviated, improving the black density. In addition, as in the case of embodiment 2, an increase in the amount of the low-permeation ink after the black, high permeation ink has penetrated the print medium makes it possible to inhibit mixing of the black, low-permeation ink and the black, high-permeation ink in the outer peripheral area. As a result, the amount of the black, low-permeation ink applied to the outer periphery is reduced, but the print of an image with clear edges is achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-163892, filed Jul. 21, 2010, which is hereby incorporated by reference herein in its entirety.

What is claimed is:

1. An inkjet printing apparatus, comprising:

a printing head comprising:

a first nozzle array constructed to eject a first ink, a second nozzle array constructed to eject a second ink, and a third nozzle array constructed to eject the second ink, wherein the first nozzle array is disposed between the second nozzle array and the third nozzle array along a scan path, and wherein the second ink is a substantially same color as a color of the first ink, and has relatively lower permeation properties with respect to a print medium than permeation properties of the first ink with respect to the print medium;

a scanning unit configured to cause the printing head to scan a print medium along the scan path to print an image thereon; and a printing control unit configured to control ejection of ink from the printing head so as to print on an edge area using the second ink, and print on a non-edge area using the first ink, wherein the edge area and the non-edge area are located in a printing area corresponding to an image to be printed on the print medium, and the non-edge area is a region surrounded by the edge area.

2. The printing apparatus according to claim 1, wherein the printing control unit is further configured to control the printing head such that a rate of printing for a nozzle array, of the second nozzle array and the third nozzle array, which is located behind the first nozzle array in a current scan direction is higher than a rate of printing for a nozzle array, of the second nozzle array and the third nozzle array, which is located in front of the first nozzle array in the current scan direction.

3. The printing apparatus according to claim 1, wherein the printing control unit controls the printing head so that an amount of the second ink ejected per unit region to the edge area is greater than an amount of the first ink ejected per unit region to the non-edge area.

4. The printing apparatus according to claim 1, wherein the printing control unit controls the printing head to use the second ink without using the first ink to print on the edge area, and to use the first ink without using the second ink to print on the non-edge area.

5. The printing apparatus according to claim 1, wherein the printing control unit controls the printing head to use the second ink without using the first ink to print on the edge area, and to use the first ink and the second ink to print on the non-edge area.

6. The printing apparatus according to claim 1, wherein the first ink and the second ink are types of black ink.

7. The printing apparatus according to claim 6, further comprising:

a detecting unit configured to detect the edge area and the non-edge area in the printing area based on a printing data corresponding to black ink.

8. An inkjet printing method of printing on a print medium, comprising:

a scanning step of scanning a print medium with a printing head comprising:

a first nozzle array constructed to eject a first ink, a second nozzle array constructed to eject a second ink, and a third nozzle array constructed to eject the second ink, wherein the first nozzle array is disposed between the second nozzle array and the third nozzle array along a scan path, and wherein the second ink has a substantially same color as a color of the first ink, and has relatively lower permeation properties with respect to the print medium than permeation properties of the first ink with respect to the print medium; and a printing step of (i) printing on an edge area of the print medium using the second ink, and (ii) printing on a non-edge area of the print medium using the first ink, wherein the edge area and non-edge area are located in a printing area corresponding to an image to be printed on the print medium, and the non-edge area is a region surrounded by the edge area.

9. The inkjet apparatus according to claim 1, wherein the print control unit ejects the second ink to the edge area from both the third nozzle array and the second nozzle array.

10. The inkjet apparatus according to claim 1, wherein the first ink and the second ink include pigment as a color material.

11. The inkjet apparatus according to claim 1, wherein the print control unit controls the printing head to eject ink in both forward and backward scans in the scan direction to print the image.

* * * * *